United States Patent [19]

McLravy, II et al.

[11] 4,210,085

[45] Jul. 1, 1980

[54] FOLDING ARTICLE OF FURNITURE

[76] Inventors: Robert C. McLravy, II, 505 Richard Ave., Lansing, Mich. 48917; Michael F. Zakowski, 906 Miner, Ann Arbor, Mich. 48103

[21] Appl. No.: 791,999

[22] Filed: Jun. 14, 1977

[51] Int. Cl.[2] ..... A47B 3/00

[52] U.S. Cl. ..... 108/35; 108/118; 108/34

[58] Field of Search ..... 108/34, 35, 36, 115, 108/118, 124, 128, 127, 130, 131, 132, 135, 153

[56] References Cited

U.S. PATENT DOCUMENTS

| | | | |
|---|---|---|---|
| 29,580 | 8/1860 | Garrettson | 108/128 |
| 405,117 | 6/1889 | Purdy et al. | 108/128 |
| 455,681 | 7/1891 | Cummer | 108/35 |
| 1,213,976 | 1/1917 | Tenley | 108/35 |
| 1,391,833 | 9/1921 | Kaiser | 108/35 |
| 1,608,924 | 11/1926 | Brown | 108/118 |
| 1,741,576 | 12/1926 | Lewis | 108/35 |
| 1,804,171 | 5/1931 | Lewis | 108/35 |
| 2,742,335 | 4/1956 | Hitchcock et al. | 108/35 |

*Primary Examiner*—Ramon S. Britts
*Assistant Examiner*—Peter A. Aschenbrenner

[57] ABSTRACT

A folding table unit for camping, boating and traveling which includes a multipanel top which folds to provide an elongate rectangular enclosure, and a folding leg assembly which can store within the table top enclosure and which opens to provide a table top support. A unique hinge plate at the juncture of multiple leg supports facilitates the folding of the legs and provides a location for mutual leg support all in a single plane to reduce the folded dimension of the leg assembly.

9 Claims, 12 Drawing Figures

FIG.6
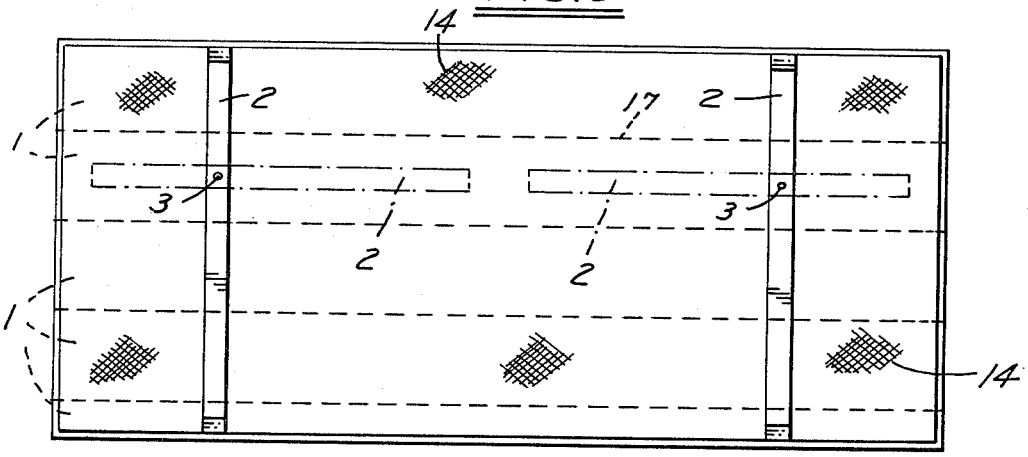
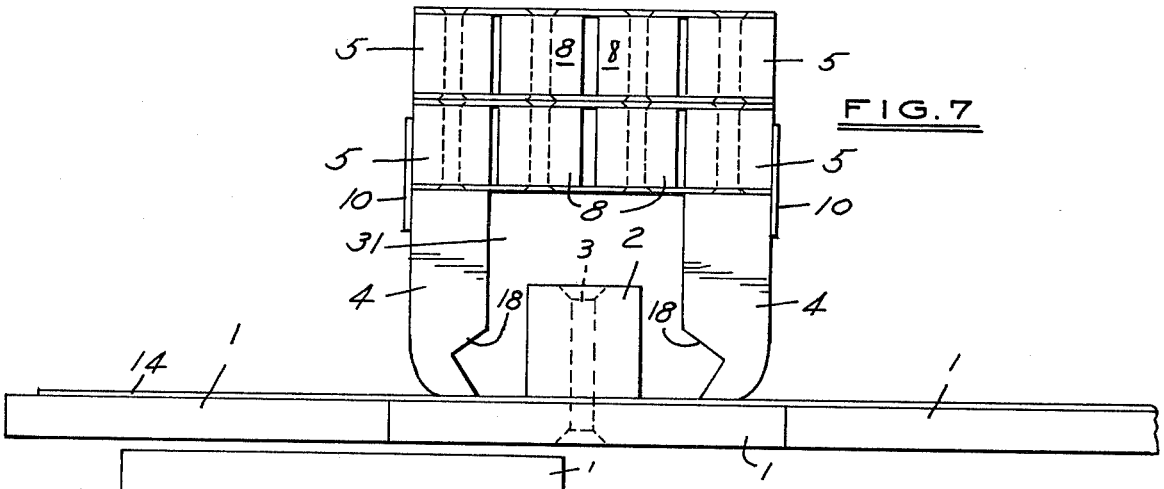
FIG.7
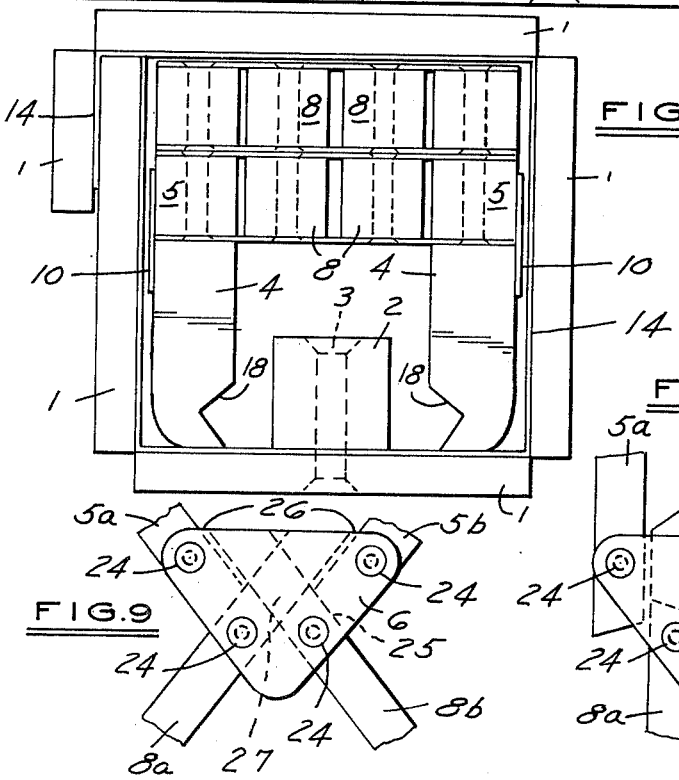
FIG.8
FIG.11
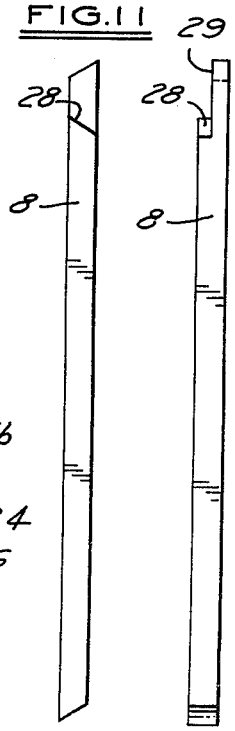
FIG.10
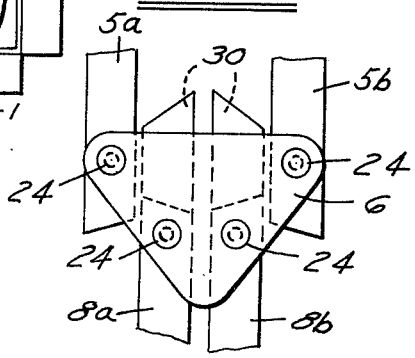
FIG.9
FIG.12

FOLDING ARTICLE OF FURNITURE

The present invention relates to a folding article of furniture and more particularly to a folding or collapsible bench, chair or table.

BACKGROUND OF THE INVENTION

When camping or boating or the like, it is desirable to have some means available for forming an eating surface or work surface. Yet, because these devices are often heavy and bulky, it is inconvenient, if not impossible, to travel with them. Space considerations, will not permit it. Problems concerning lack of space are not, however, limited to situations occurring away from the home. Frequently, a piece of furniture is necessary for special occasions; yet there is no convenient way to store it when it is not being used.

OBJECTS OF INVENTION

It is an object of the present invention to provide a folding table which is compact and light in the folded position but which can be easily set up and utilized when needed.

It is a further object of the invention to provide a unique folding leg construction which is inexpensive to construct and which has relatively simple hardware components.

A further object of the invention relates to a leg construction which in folded condition cooperates with table braces to assist a user in positioning the folded legs when collapsing the device for storage.

A still further object is a brace construction for the top component which can be moved to a storage position to nest in the fold leg component.

The article to be described consists of a folding top panel and a set of folding legs. The panel and legs are so dimensioned that the table top will wrap around the collapsed legs to form a compact elongate package for carrying or storage.

The collapsible table shown constructed according to the present invention solves both the weight and space problems. The table is designed in such a manner to be light in weight, yet strong. Moreover, the table folds in such a way so as to permit easy storage. The table consists of two basic sections: a base and a top. In the collapsed position, the base has a width of slightly more than the sum of the width of the four legs that make up each leg section and a depth of slightly more than the sum of the depths of one of the frame pieces and two of the leg pieces. This base section fits into the top in such a manner that assembly and disassembly is easily effectuated. In the collapsed position, the top wraps around the base to form a box shape. This box shape can readily fit into a case to permit easy storage or portability. The table is designed to be aesthetically pleasing while preserving the great functionality provided by its collapsible features.

PRIOR ART

Tables utilizing folding legs and folding top panels are known. The present invention is an improvement in the art of folding tables in the several features above mentioned and those which will be evident in the following description and claims. Patented art known to the inventors is found in the following U.S. Pat. Nos.:

29,580 (1860)
550,256 (1895)

3,638,588 (1972)

BRIEF DESCRIPTION OF THE INVENTION

The collapsible table is comprised of two separable structures: a top and a base. The top is composed of longitudinal slats attached longitudinally to each other in such a manner as to allow flexibility and one or more movable crossbars attached to the underside of the slats in such a manner as to allow pivoting in the plane of the slats. The base is composed of two longitudinal frame pieces designed to receive the top and two sets of X-shaped legs hinged where they meet the frame pieces. Each leg section is composed of four pieces attached to each other by a hingle plate in such a manner that each leg section lies in one plane. The base is braced in various manners to insure stability.

In the open position, the top rests on the key ways in the frame pieces of the base. The top is made rigid by pivoting the crossbars so that they lie transversely of the panels of the top structure.

In the closed position, the X-shaped leg sections are in the parallel closed position and are folded parallel to the frame.

A gap formed by spaced frame pieces in the folded position is placed over the crossbars. The slats of the top are now wrapped around the base to form a box-type shape which can be put in a carrying case for easy transportation. The principal object of the invention is to provide a lightweight, sturdy, aesthically pleasing table that can be compressed into a small area.

Other features of the invention will be evident in the following description and claims in which the principles of the invention are set forth together with details which will enable a person skilled in the art to practice the invention, all in connection with the best mode presently contemplated for the practice of the invention.

Drawings accompany the disclosure and the various views thereof are briefly described as follows:

FIG. 6 is a bottom view of the top showing the crossbars in open and closed positions.

FIG. 7 is an end view of the table in a partially closed position.

FIG. 8 is an end view of the table in a closed position.

FIG. 9 is a fragmentary view of the leg structure in an open position.

FIG. 10 is a fragmentary view of the leg structure in a closed position.

FIG. 11 is a side view of the lower lg.

FIG. 12 is a front view of the lower leg.

DESCRIPTION OF THE PREFERRED EMBODIMENT

Figure 1:
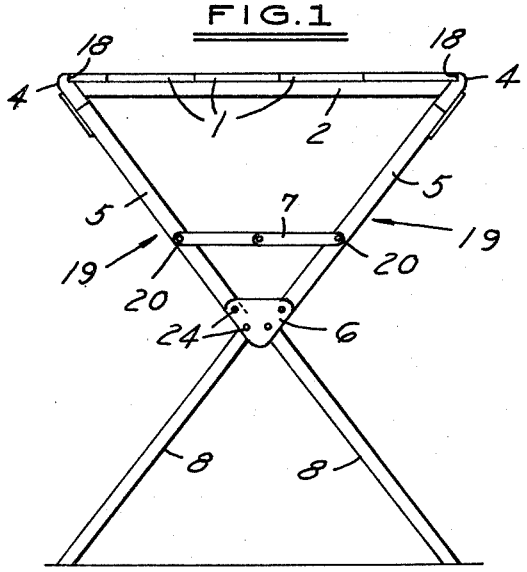
FIG. 1 is a front view of the table in an open position.

Like characters of reference designate like parts in these figures of the drawings in which they occur.

Figure 4:
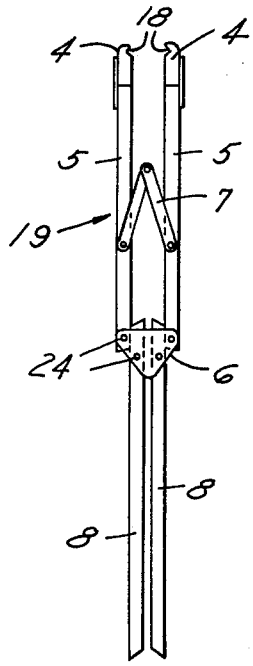
FIG. 4 is a front view of the base in a partially collapsed position.

In the drawings:

The table is comprised of folding or wrap-up top (FIG. 6) and the collapsible base (FIG. 4).

The top is comprised of the slats 1, the crossbar 2, the fastening device 3, the attaching device 14 (all shown in FIG. 6).

Figure 3:
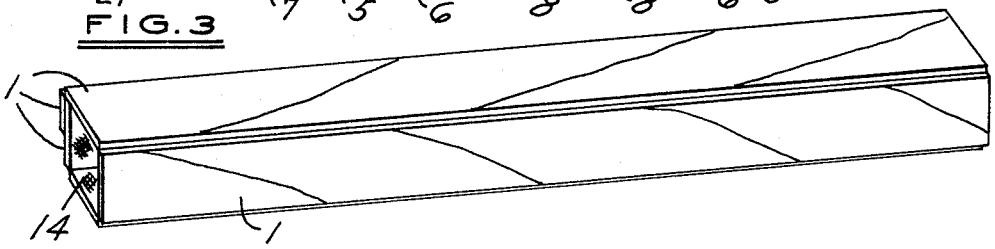
FIG. 3 is an oblique view of the table in a closed position.

The top consists of slats 1 placed adjacent to each other and held to each other by the attaching device 14 (FIG. 6). The attaching device can be a piece of canvas or other suitable material which is glued to the bottom of the slats to form a hinge between adjacent slats. The joined slats serve as the top in the open extended position as shown in FIGS. 1 and 6 and, when folded, as the box for the base as shown in FIG. 3. The crossbars 2 are connected to one of the slats at a pivot point (FIG. 6) by a rivet, bolt or other device 3. When perpendicular to the longitudinal dimensions of the top in unfolded and open position (FIG. 6), the crossbars stiffen the top to provide a rigid plane (FIG. 1). When the crossbars are parallel to the longitudinal dimension 17 (FIG. 6), they serve, first, to guide the placing of the base of the base on the top during the collapsing process and, second, to retain the box structure when the table is fully collapsed.

The folding or collapsible base frame is comprised of the frame pieces 4 (FIGS. 1 and 2), the upper legs 5, the lower legs 8, the hinge plates 6, the stiffening braces 7 and 9, the L-shaped brackets 10 and 11, one being shorter than the other to achieve the proper nesting when folded.

The top frame pieces 4 hold the top in place when the table is in the open position. This is accomplished by means of the keyways or notches shown at 18 in FIGS. 1 and 4. The slats and frames are constructed in such a manner that the upper surface of the top and the upper end of the frame pieces are flush with each other when the table is open.

Figure 5:
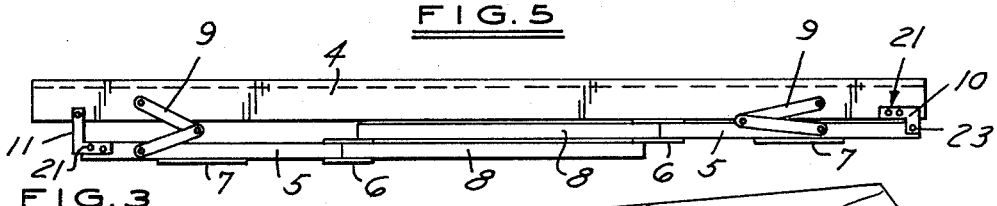
FIG. 5 is a side view of the base in a collapsed position.

The upper leg sections 5, shown generally at 19, are connected to the frames by the brackets 10 and 11 which serve as hinges, one leg of each being connected to the frame by a single pivot. The hinges are constructed and mounted to allow folding the leg section containing hinge 10 against the bottom of the frame and the leg section containing hinge 11 against the leg section with hinge 10 as shown in FIG. 5. The hinges are connected to the frame and leg sections at 21 (FIG. 2) and pivot at 22 and 23 (FIG. 5). This method of folding assures maximum nesting of the parts.

Figure 2:
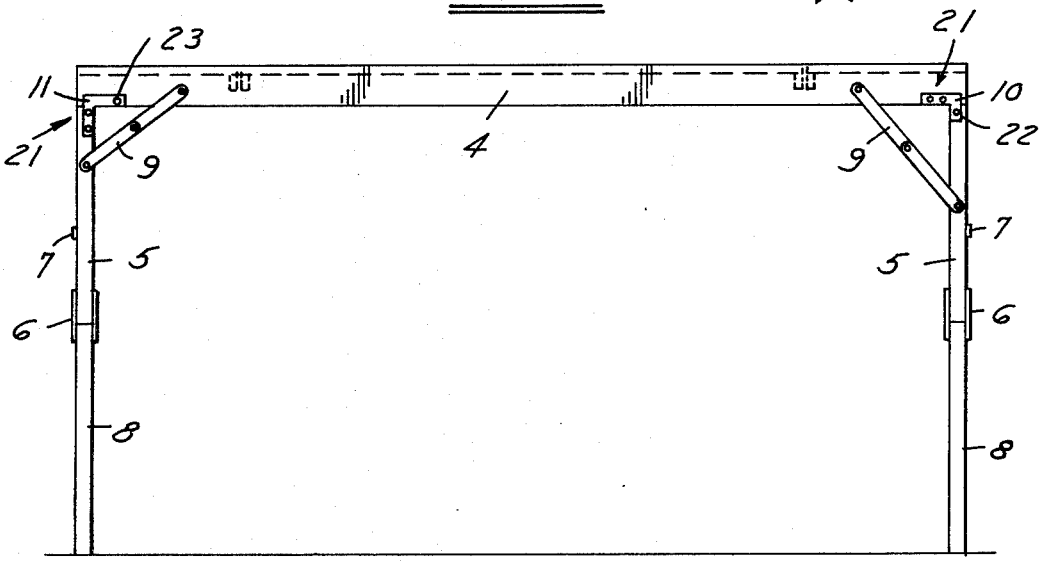
FIG. 2 is a side view of the table in an open position.

The leg sections are held firmly in the open position by the stiffening braces 7 (FIG. 2) and 9 (FIG. 3) and pivoted to the base as shown at 20 in FIGS. 1 and 2. They are shown in the broken position in FIGS. 4 and 5.

Each leg section lies in one plane to assure maximum collapsibility. Each leg section is comprised of two upper legs 5 (FIG. 4), two hinge plates 6 (FIG. 4), and two lower legs 8 (FIG. 4). The legs pivot and are connected to the hinge plates at 24 (FIG. 4).

FIG. 9 shows a fragmentary stylized version of the leg sections when the table is open. The legs rest on each other at 25, 26, 27 (FIG. 9). The gaps are shown for descriptive purposes only. The lower angled end of leg 5*a* rests on leg 8*a* at 25. Leg 8*b* contacts leg 5*a* at 26. Legs 8*a* and 8*b* rest on each other at 27. The lower end of leg 5*b* rests on leg 8*b* at 25. Finally, leg 5*b* contacts on leg 8*a* at 26.

The lower leg 8 is cut inward at the angle shown at 28 (FIG. 11) and is dadoed to the depth shown at 29 (FIG. 12). This allows the legs to interfit and operate in one plane (FIGS. 9 and 10) and to support each other at the intersection of the faces formed by the dadoes 30 (FIGS. 9 and 10).

The hinging device formed in this manner compacts the legs which can lie in the same plane and still permits folding into the closed position (FIG. 1). The legs also reinforce each other at faces.

When the legs are collapsed to the position shown in FIGS. 7 and 8, there is a space 31 which locates over the crossbars 2 on the folded top section. This feature gives stability to the closed unit, avoids confusion when putting the collapsed base on the top (FIG. 7) and allows the top to be readily located and wrappd around the base conveniently (FIG. 8). FIG. 8 shows the wrap-around feature of the top made possible by joining the slats (FIG. 6) with the attaching flexible hinging sheet 14 (FIG. 6). The top now forms a box around the base. The attaching material protects the surfaces of the base that are exposed to the folded top (FIG. 8).

The invention is subject to changes or alterations without defeating its practicability; therefore, we do not wish to be confined to the preferred embodiment shown in the drawings and described herein.

OPERATION

To open the table, the box formed by the top is placed with the crossbars 2 facing up. The top is unwrapped until it lies flat. The base is removed from the top and the outermost leg section is pivoted until it forms approximately a 93° interior angle with the frame and the top of the leg section butts against the frame. The other leg section is now pivoted until it forms approximately a 93° interior angle with the frame and the top of the leg section butts against the bottom of the frame. The two frame pieces are pulled apart to open the X-leg sections into the X-type open position. The braces are opened to the stiffening position. The base is now in an open position ready for the top to be positioned.

The crossbars are now pivoted to form approximately a 90° angle with the longitudinal dimension of the top. The top is now in an open position and is placed with the crossbars facing down on the base in such a manner so that the outside longitudinal edges of the top fit in the notches or keyways 18 in the frame pieces.

The table is now in an open position and ready for use. To collapse the table, the top is removed from the frame. The stiffening braces on the base are collapsed and the frame pieces are pushed together. This collapses the X-shaped leg sections so that the two leg pieces are parallel and adjacent to each other and so that the top leg pieces 5, 5 and 8, 8 are parallel to each other and separated by the width of the two bottom leg pieces. The leg section with the pivot point 22 on the upper leg is folded toward the other leg section and rests parallel and adjacent to the bottom of the longitudinal frame pieces. The leg section with the pivot point 23 on the frame is folded towards the other leg section and rests parallel and adjacent to the other leg section. The base is now fully collapsed. The top is placed such that the crossbars 2 are facing upward. The crossbars are pivoted so that they are parallel with the longitudinal dimension of the slats.

The base is placed on the top such that the gap 31 in the base formed by the separation in the two frame pieces is placed over the crossbars. The slats are now wrapped around the base to form a box-like shape. The table is now in a collapse position and can be put in a carrying case for convenient transportation or storage.

We claim:

1. A collapsible table comprising:

(a) a rigid table top comprising a plurality of rigid, elongate panels, a uniformly distributed connecting means holding said panels to each other, and said panels being of equal length and thickness and having widths dimensioned so that said panels fold to form a rectangular enclosure;

(b) at least one crossbar member being of one-piece construction and pivotally mounted to the bottom surface of one of said panels, said crossbar member being movable from a closed position in parallel contiguous subjacent relation to said panels to an open position in transverse contiguous subjacent relation to said panels to rigidify said panels into a table top unit; and (c) supporting means detachably connected to said table top for supporting said table top in a horizontal plane and including:

(1) two sets of four element leg units, each of said leg units disposed at opposing ends of said supporting means, and each of said leg units being collapsible from an open supporting position to a closed parallel position, (2) longitudinal members extending between said leg units and hinged to said leg units for permitting said leg units to fold to a position parallel to said longitudinal members, and (3) two center hinge plates each pivotally connected to one of said leg units so that each of said leg units radiate outward therefrom in a single plane, whereby said crossbar engages said longitudinal members in an oblique abutting relation by which said longitudinal members support said crossbar when said crossbar is in said open position.

2. A table structure as defined in claim 1 in which each set of said four element leg units comprise, a center hinge plate from which said four leg elements radiate, means pivoting each leg element to said hinge plate, two of said leg elements extending upward to support said longitudinal means when opened, to support the table top, and two of said leg elements extending downward from said hinge plate and interfitting in a mutual abutting scissor-like fashion to support the entire structure at rest on a surface whereby each of said leg elements is hinged to undergo dependent relative coplanar motion in a single plane.

3. A table structure as defined in claim 1 in which said upwardly extending legs pivot to an open position and cause said downwardly extending legs to pivot to an open position whereby the lower ends of the upwardly extending legs engage the downwardly extending legs in an oblique abutting fashion.

4. A table structure as defined in claim 1 in which the leg units and longitudinal connecting means collapse to a generally rectangular shaped assembly having an elongate cavity on one side thereof, said cavity interfitting over the crossbars, which are in a colinearly aligned closed position, to locate the leg units prior to folding the elongate panels around the legs to incase them for storage.

5. A table structure defined in claim 1 in which said sets of leg units are hinged to the longitudinal means such that one set folds against the bottom of said longitudinal means and the other set folds against the first set in such a way that the longitudinal means and the leg units are parallel, adjacent, and coplanar when the structure is in a folded position.

6. A collapsible table comprising:

(a) a rigid table top constructed of a plurality of rigid, elongate panels hinged together to permit said panels to be folded to form a rectangular enclosure, said table top including at least one crossbar of one-piece construction pivoted to the bottom surface of one of said panels and movable from a closed position in parallel contiguous subjacent relation to said panels to an open position in transverse contiguous subjacent relation of said panels to rigidify said panels into a table top unit, said crossbar supported in said open position by longitudinal members of a detachable support means which said crossbar engages in oblique abutting relation; and (b) said detachable supporting means for holding said top in a horizontal position with said panels unfolded and comprising two sets of interlocking four element leg units each having an open supporting position and a closed position, and longitudinal connecting means positioned between said leg units and hinged to said leg units and adapted to engage and support said crossbar in said open position and to permit folding of said closed leg units to a position parallel to said connecting means.

7. A table structure as defined in claim 6 in which the leg units and longitudinal connecting means collapse to a generally rectangular shaped assembly having an elongate cavity on one side thereof for interfitting said assembly over said crossbars when said crossbars are in a colinearly aligned closed position so as to locate said leg units prior to folding said elongate panels around said legs to encase them for storage.

8. A table structure defined in claim 6 in which said sets of leg units are hinged to said longitudinal means such that one set folds against the bottom of said longitudinal means and the other set folds against said first set in such a way that said longitudinal means and said leg units are parallel, adjacent, and coplanar when said structure is in a folded position.

9. A collapsible table comprising:

(a) a rigid table top constructed of a plurality of rigid, elongate panels hinged to permit said panels to be folded to form a rectangular enclosure, said table top including at least one crossbar of one-piece construction, pivotally mounted on the bottom surface of one of said panels and movable from a closed position parallel to said panels to an open position transverse of said panels to rigidify said panels into a table top unit, and (b) a detachable support means for holding said top in a horizontal position with said crossbar in said open position comprising two sets of interfitting leg units hinged to move between an open and a closed position in a first plane, and longitudinal connecting means positioned between said sets of leg units and hinged to said leg units to permit folding of said leg units in a second plane to a position parallel to said connecting means thereby forming a generally rectangular shaped assembly to be encased by said panels for storage.

* * * * *